US007208876B2

(12) United States Patent
Kang et al.

(10) Patent No.: US 7,208,876 B2
(45) **Date of Patent: *Apr. 24, 2007**

(54) PLASMA DISPLAY PANEL

(75) Inventors: Kyoung-Doo Kang, Seoul (KR); Woo-Tae Kim, Yongin-si (KR); Hun-Suk Yoo, Cheonan-si (KR); Seok-Gyun Woo, Asan-si (KR); Jae-Ik Kwon, Asan-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/874,517

(22) Filed: Jun. 23, 2004

(65) Prior Publication Data

US 2005/0017637 A1 Jan. 27, 2005

(30) Foreign Application Priority Data

Jul. 22, 2003 (KR) ..... 10-2003-0050278
Jul. 22, 2003 (KR) ..... 10-2003-0050282
Jul. 30, 2003 (KR) ..... 10-2003-0052598
Aug. 1, 2003 (KR) ..... 10-2003-0053461

(51) Int. Cl.
*H01J 17/49* (2006.01)

(52) U.S. Cl. ..... 313/582; 313/585; 315/169.4; 345/37; 345/41; 345/60

(58) Field of Classification Search ..... 313/581–587; 315/169.4; 345/41, 60, 37
See application file for complete search history.

(56) References Cited

U.S. PATENT DOCUMENTS 5,640,068 A 6/1997 Amemiya
5,661,500 A 8/1997 Shinoda et al.
5,952,782 A 9/1999 Nanto et al.
6,200,182 B1 3/2001 Nanto et al.
6,249,264 B1 6/2001 Sano et al.
6,288,488 B1 9/2001 Amemiya (Continued)

FOREIGN PATENT DOCUMENTS

CN 1264914 8/2000

(Continued)

OTHER PUBLICATIONS

U.S. Appl. No. 10/746,540, filed Dec. 23, 2003, Kwon et al.

(Continued)

*Primary Examiner*—Karabi Guharay
*Assistant Examiner*—Anthony Canning
(74) *Attorney, Agent, or Firm*—Christie, Parker & Hale, LLP

(57) ABSTRACT

A plasma display panel. A first substrate and a second substrate are provided opposing one another with a predetermined gap therebetween. Address electrodes are formed on the second substrate. Barrier ribs are mounted between the first substrate and the second substrate, the barrier ribs defining a plurality of discharge cells. Also, red, green, and blue phosphor layers are formed within each of the discharge cells. Discharge sustain electrodes are formed on the first substrate. The barrier ribs comprise first barrier rib members formed substantially parallel to the direction of the address electrodes, and second barrier rib members obliquely connected to the first barrier rib members and intersecting over the address electrodes. The second barrier rib members are formed to different widths according to discharge cell color such that red, green, and blue discharge cells have different volumes.

7 Claims, 10 Drawing Sheets

U.S. PATENT DOCUMENTS

| | | | |
|---|---|---|---|
| 6,373,195 | B1 | 4/2002 | Whang et al. |
| 6,376,986 | B1 | 4/2002 | Takagi et al. |
| 6,424,095 | B1 | 7/2002 | Hirao et al. |
| 6,479,932 | B1 | 11/2002 | Nunomura |
| 6,495,957 | B2 | 12/2002 | Kurogi et al. |
| 6,534,914 | B2 | 3/2003 | Amemiya et al. |
| 6,608,441 | B2 | 8/2003 | Kunii et al. |
| 6,639,363 | B2 | 10/2003 | Amatsuchi et al. |
| 6,657,386 | B2 | 12/2003 | Koshio et al. |
| 6,670,754 | B1 | 12/2003 | Murai et al. |
| 6,703,772 | B2 | 3/2004 | Hasegawa et al. |
| 6,853,136 | B2 | 2/2005 | Kim et al. |
| 2002/0021090 | A1 | 2/2002 | Sano et al. |
| 2002/0063510 | A1 | 5/2002 | Yura et al. |
| 2003/0193487 | A1 | 10/2003 | Yatsuda et al. |
| 2004/0051457 | A1 | 3/2004 | Kimura et al. |
| 2004/0085264 | A1 | 5/2004 | Takada et al. |
| 2004/0256989 | A1 | 12/2004 | Kim et al. |
| 2004/0263078 | A1 | 12/2004 | Seok et al. |
| 2005/0001551 | A1 | 1/2005 | Kim et al. |
| 2005/0029939 | A1 | 2/2005 | Woo et al. |

FOREIGN PATENT DOCUMENTS

| | | | |
|---|---|---|---|
| CN | 1267877 | | 9/2000 |
| CN | 1327253 | | 12/2001 |
| CN | 1337665 | | 2/2002 |
| CN | 1344005 | | 4/2002 |
| CN | 1397976 | | 2/2003 |
| EP | 0 920 048 | A2 | 6/1999 |
| EP | 1 263 014 | A1 | 12/2002 |
| JP | 4-298936 | | 10/1992 |
| JP | 5-94772 | | 4/1993 |
| JP | 6-342631 | | 12/1994 |
| JP | 10-149771 | | 6/1998 |
| JP | 10-269951 | | 10/1998 |
| JP | 10-283934 | | 10/1998 |
| JP | 10-308179 | | 11/1998 |
| JP | 10-334811 | | 12/1998 |
| JP | 11-96921 | | 4/1999 |
| JP | 11-213893 | | 8/1999 |
| JP | 11-317170 | | 11/1999 |
| JP | 11-345570 | | 12/1999 |
| JP | 2000-11899 | | 1/2000 |
| JP | 2000-21313 | | 1/2000 |
| JP | 2000-42661 | | 2/2000 |
| JP | 2000-187200 | | 7/2000 |
| JP | 2000-195431 | | 7/2000 |
| JP | 2000-323045 | | 11/2000 |
| JP | 2000-357459 | | 12/2000 |
| JP | 2001-160361 | | 6/2001 |
| JP | 2001-210241 | | 8/2001 |
| JP | 2001-283734 | | 10/2001 |
| JP | 2001-345054 | | 12/2001 |
| JP | 2002-25451 | | 1/2002 |
| JP | 2002-83545 | | 3/2002 |
| JP | 2002-190256 | | 7/2002 |
| JP | 2002-197981 | | 7/2002 |
| JP | 2002-231146 | | 8/2002 |
| JP | 2002-245943 | | 8/2002 |
| JP | 2002-260537 | | 9/2002 |
| JP | 2002-324488 | | 11/2002 |
| JP | 2002-373593 | | 12/2002 |
| JP | 2003-16944 | | 1/2003 |
| JP | 2003-31130 | | 1/2003 |
| JP | 2003-68212 | | 3/2003 |
| JP | 2003-68215 | | 3/2003 |
| JP | 2003-132805 | | 5/2003 |
| JP | 2003-303550 | | 10/2003 |
| JP | 2003-303551 | | 10/2003 |
| JP | 2004-164885 | | 6/2004 |
| KR | 1998-030878 | | 8/1998 |
| KR | 1999-0062632 | | 7/1999 |
| KR | 1999-0065408 | | 8/1999 |
| KR | 2001-0016651 | | 3/2001 |
| KR | 2001-0062222 | | 7/2001 |
| KR | 2001-0093724 | | 10/2001 |
| KR | 2002-0036012 | | 5/2002 |
| KR | 2002-0055807 | | 7/2002 |
| KR | 2002-0069025 | | 8/2002 |
| KR | 2003-0044667 | | 6/2003 |
| KR | 2003-0061079 | | 7/2003 |
| KR | 10-2004-0032508 | A | 4/2004 |
| WO | WO99/50877 | | 10/1999 |
| WO | WO 00/46832 | | 8/2000 |

OTHER PUBLICATIONS

U.S. Appl. No. 10/746,541, filed Dec. 23, 2003, Kwon et al.

U.S. Appl. No. 10/751,341, filed Jan. 2, 2004, Kwon et al.

Patent Abstracts of Japan for Publication No. 10-149771, Date of publication of application Jun. 2, 1998, in the name of N. Yatsuda et al.

Patent Abstracts of Japan for Publication No. 2001-345054, Date of publication of application Dec. 14, 2001, in the name of K. Sano et al.

Patent Abstracts of Japan for Publication No. 2002-231146, Date of publication of application Aug. 16, 2002, in the name of S. Yura et al.

Korean Patent Abstracts for Publication No. 1020030061079, Date of publication of application Jul. 18, 2003, in the name of Y. Ahn et al.

Korean Patent Abstracts for Publication No. 1020010093724; Date of publication of application Oct. 29, 2001, in the name of K. Morikawa.

Patent Abstracts of Japan for Publication No. 2001-210241; Date of publication of application Aug. 3, 2001, in the name of T. Kosaka.

Patent Abstracts of Japan for Publication No. 2002-083545; Date of publication of application Mar. 22, 2000, in the name of T. Kunii et al.

Patent Abstracts of Japan Publication No. 2000-195431; Date of publication of application Jul. 14, 2000, in the name of T. Komaki.

European Search Report, for Application No. 04090020.1, dated Feb. 3, 2005, in the name of Samsung SDI Co., Ltd.

Patent Abstracts of Japan for Publication No. 2002-190256, Date of publication of application Jul. 5, 2002, in the name of Y. Takada.

Korean Patent Abstracts for Publication No. 1020010062222, Date of publication of application Jul. 7, 2001, in the name of K. Amemiya et al.

Korean Patent Abstracts for Publication No. 1019990065408A; Date of publication of application Aug. 5, 1999, in the name of S. Lee.

Patent Abstracts of Japan for Publication No. 2001-160361, Date of publication of application Jun. 12, 2001, in the name of S. Yura et al.

Patent Abstracts of Japan for Publication No. 2002-324488, Date of publication of application Nov. 8, 2002, in the name of N. Hirano et al.

Patent Abstracts of Japan for Publication No. 04-298936; Date of publication of application Oct. 22, 1992, in the name of T. Okajima.

Korean Utility Model Abstracts for Publication No. 2019980030878A; Date of Publication of Application Aug. 17, 1998, in the name of B. Choi.

Search Report for European Patent Application No. 04090020.1 dated Feb. 3, 2005.

Patent Abstracts of Japan, Publication No. 10-308179, Publication Date Nov. 17, 1998, in the name of Aoto et al.

Patent Abstracts of Japan, Publication No. 2002-245943, Publication Date Aug. 30, 2002, in the name of Morikawa et al.

Patent Abstracts of Japan, Publication No. 2003-303550, Publication Date Oct. 24, 2003, in the name of Kan.

Patent Abstracts of Japan, Publication No. 2003-303551, Publication Date Oct. 24, 2003, in the name of Kan.

Korean Patent Abstracts, Publication No. 1020020036012 A, Publication Date May 16, 2002, in the name of Kim.
Korean Patent Abstracts, Publication No. 1020040032508 A, Publication Date Apr. 17, 2004, in the name of Lee.
Patent Abstracts of Japan for Publication No. 10-283934; Date of publication of application: Oct. 23, 1998, in the name of Tsutomu Tokunaga et al.
Patent Abstracts of Japan for Publication No. 11-345570; Date of publication of application: Dec. 14, 1999, in the name of Takaaki Murata et al.
Patent Abstracts of Japan for Publication No. 2000-011899; Date of publication of application: Jan. 14, 2000, in the name of Kimio Amamiya.
Patent Abstracts of Japan for Publication No.: 2000-021313; Date of publication of application: Jan. 21, 2000, in the name of Kenji Yoshida et al.
Patent Abstracts of Japan Publication No. 2000-323045; Date of publication of application: Nov. 24, 2000, in the name of Kazuki Takagi et al.
Patent Abstracts of Japan for Publication No. 2001-283734; Date of publication of application: Oct. 12, 2001, in the name of Sukeyuki Nishimura et al.
Patent Abstracts of Japan for Publication No. 2002-373593; Date of publication of application: Dec. 26, 2002, in the name of Hiroshi Kanda.
Patent Abstracts of Japan, Publication No. 05-094772; Publication Date: Apr. 16, 1993; in the name of Noborio.
Patent Abstracts of Japan, Publication No. 10-334811; Publication Date: Dec. 18, 1998; in the name of Aoki et al.
Patent Abstracts of Japan, Publication No. 11-096921; Publication Date: Apr. 9, 1999; in the name of Tomioka et al.
Patent Abstracts of Japan, Publication No. 11-317170; Publication Date: Nov. 16, 1999; in the name of Kado et al.
Patent Abstracts of Japan, Publication No. 2000-042661; Publication Date: Feb. 15, 2000; in the name of Arima et al.
Patent Abstracts of Japan, Publication No. 2000-357459; Publication Date: Dec. 26, 2000; in the name of Jae et al.
Patent Abstracts of Japan, Publication No. 2002-260537; Publication Date: Sep. 13, 2002; in the name of Ito et al.
Korean Patent Abstracts, Publication No. 1020010016651 A; Publication Date: Mar. 5, 2001; in the name of Park.
Korean Patent Abstracts, Publication No. 1020020055807 A; Publication Date: Jul. 10, 2002; in the name of Kim.
Korean Patent Abstracts, Publication No. 1020030044667 A; Publication Date: Jun. 9, 2003; in the name of Lee.
Patent Abstracts of Japan, Publication No. 06-342631, Published Dec. 13, 1994 in the name of Noborio.
Patent Abstracts of Japan, Publication No. 10-269951, Published Oct. 9, 1998 in the name of Fumihiro.
Patent Abstracts of Japan, Publication No. 11-213893, Published Aug. 6, 1999 in the name of Toshie et al.
Patent Abstracts of Japan, Publication No. 2000-187200, Published Jul. 4, 2000 in the name of Pascale et al.
Patent Abstracts of Japan, Publication No. 2002-025451, Published Jan. 25, 2002 in the name of Toshihiko et al.
Patent Abstracts of Japan, Publication No. 2002-197981, Published Jul. 12, 2002 in the name of Toshihiro et al.
Patent Abstracts of Japan, Publication No. 2003-016944, Published Jan. 17, 2003 in the name of Kimio.
Patent Abstracts of Japan, Publication No. 2003-031130, Published Jan. 31, 2003 in the name of Eishiro et al.
Patent Abstracts of Japan, Publication No. 2003-068212, Published Mar. 7, 2003 in the name of Naoki et al.
Patent Abstracts of Japan, Publication No. 2003-068215, Published Mar. 7, 2003 in the name of Shuichi et al.
Patent Abstracts of Japan, Publication No, 2003-132805. Published May 9, 2003 in the name of Tomohiro et al.
Patent Abstracts of Japan, Publication No. 2004-164885, Published Jun. 10, 2004 in the name of Takashi et al.

PLASMA DISPLAY PANEL

CROSS REFERENCE TO RELATED APPLICATIONS

This application claims priority to and the benefit of Korea Patent Applications: No. 2003-0050282 filed on Jul. 22, 2003, No. 2003-0050278 filed on Jul. 22, 2003, No. 2003-0052598 filed on Jul. 30, 2003, No. 2003-0053461 filed on Aug. 1, 2003, all in the Korean Intellectual Property Office, the entire content of which are incorporated herein by reference.

BACKGROUND OF THE INVENTION (a) Field of the Invention

The present invention relates to a plasma display panel (PDP), and more particularly, to a PDP that optimizes a structure of barrier ribs according to characteristics of red, green, and blue phosphors to improve the efficiency of phosphors of discharge cells and make discharge characteristics uniform.

(b) Description of the Related Art

A PDP is a display device that uses vacuum ultraviolet rays generated by gas discharge in discharge cells to excite phosphors, thereby realizing the display of images. With its ability to realize high-resolution images, the PDP is emerging as one of the most popular flat panel display configurations used for wall-mounted televisions and other similar large-screen applications. The different types of PDPs include the AC-PDP, DC-PDP, and the hybrid PDP. The AC-PDP utilizing a triode surface discharge structure is becoming the most common configuration.

In the AC-PDP with a triode surface discharge structure, address electrodes, barrier ribs, and phosphor layers are formed on a rear substrate corresponding to each discharge cell. Discharge sustain electrodes comprised of scanning electrodes and display electrodes are formed on a front substrate. A dielectric layer is formed covering the address electrodes on the rear substrate, and, similarly, a dielectric layer is formed covering the discharge sustain electrodes on the front substrate. Also, discharge gas (typically an Ne—Xe compound gas) is filled in the discharge cells.

Using the above structure, an address voltage is applied between an address electrode and a scanning electrode to select a discharge cell. Next, a discharge sustain voltage of 150–200V is applied between the display electrode and the scanning electrode of the selected discharge cell such that discharge gas effects plasma discharge, and vacuum ultraviolet rays having wavelengths of 147 nm, 150 nm, and 173 nm are emitted from the excited Xe atoms made during plasma discharge. The vacuum ultraviolet rays excite phosphors so that they glow (i.e., emit visible light) and thereby enable color display.

In the PDP operating in this manner, various steps are involved between applying power to a drive circuit to visible light passing through the front substrate for viewing by a user. Significant loss occurs in this process.

Illumination efficiency of the PDP may be described as the combination of a circuit efficiency that is a factor of circuit loss, discharge efficiency when converting discharge power to ultraviolet rays, an ultraviolet usage rate when ultraviolet rays are converted to effective ultraviolet rays, and a visible light usage rate when visible light is converted into display light.

Accordingly, when designing and manufacturing the PDP, great effort is put forth into ways to minimize loss during the various steps of operation. Except for circuit efficiency, all efficiencies in the various steps of operation depend primarily on the internal structure and material characteristics of the PDP, and, in particular, discharge cell structure, discharge gas, and phosphor material characteristics. Research, therefore, is concentrated in these areas.

Phosphors used in PDPs are excited at a lower energy level than phosphors used in cathode ray tubes. Therefore, there is a limited selection of phosphors that may be used in the PDP. Phosphors typically used in PDPs have different illumination efficiencies depending on color (i.e., depending on whether red, green, or blue phosphors). Stated differently, there are significant differences in brightness of phosphors used in PDPs according to color. This results in different phosphor efficiencies and discharge characteristics for the different discharge cells, as well as difficulties in controlling white balance and color temperature.

SUMMARY OF THE INVENTION

In accordance with the present invention, a plasma display panel is provided that optimizes a structure of barrier ribs according to characteristics of red, green, and blue phosphors to improve the efficiency of phosphors of discharge cells and make discharge characteristics uniform.

A plasma display panel includes a first substrate and a second substrate provided opposing one another with a predetermined gap therebetween. Address electrodes are formed on the second substrate. Barrier ribs are mounted between the first substrate and the second substrate, the barrier ribs defining a plurality of discharge cells; red, green, and blue phosphor layers formed within each of the discharge cells. Discharge sustain electrodes are formed on the first substrate. The barrier ribs comprise first barrier rib members formed substantially parallel to the direction of the address electrodes, and second barrier rib members obliquely connected to the first barrier rib members and intersecting over the address electrodes. The second barrier rib members are formed to different widths according to discharge cell color such that red, green, and blue discharge cells have different volumes.

The second barrier rib members are formed along the direction of the address electrodes between pairs of discharge cells adjacent along the same direction and of the same color to thereby define ends of the discharge cells. The barrier ribs satisfy the following condition, $$D_1(R)>D_1(G)>D_1(B)$$

where $D_1(R)$ is a width of the second barrier rib members along the direction of the address electrodes between red discharge cells, $D_1(G)$ is a width of the second barrier rib members along the direction of the address electrodes between green discharge cells, and $D_1(B)$ is a width of the second barrier rib members along the direction of the address electrodes between blue discharge cells.

The second barrier rib members comprise non-discharge cells fully encompassed by the second barrier rib members to thereby be positioned between discharge cells adjacent in the direction of the address electrodes. The non-discharge cells satisfy the following condition, $$D_2(R)<D_2(G)<D_2(B)$$

where $D_2(R)$ is a distance between horizontal lines that are formed along a direction substantially perpendicular to the address electrodes intersecting centers of the discharge cells along the direction of the address electrodes, and closest edges of the non-discharge cells of adjacent pairs of red discharge cells closest to the horizontal lines; $D_2(G)$ is a distance between the horizontal lines and closest edges of the non-discharge cells of adjacent pairs of green discharge cells closest to the horizontal lines; and $D_2(B)$ is a distance between the horizontal lines and closest edges of the non-discharge cells of adjacent pairs of blue discharge cells closest to the horizontal lines.

The non-discharge cells have different volumes according to the color of the phosphor layers of the discharge cells adjacent in the direction of the address electrodes. Intervals between the first barrier rib members along the direction substantially perpendicular the direction of the address electrodes are substantially identical, and the non-discharge cells satisfy the following condition, $$D_3(R)>D_3(G)>D_3(B)$$

where $D_3(R)$ is the width of the non-discharge regions between red discharge cells adjacent along the direction of the address electrodes; $D_3(G)$ is a width of the non-discharge regions between green discharge cells adjacent along the direction of the address electrodes; and $D_3(B)$ is a width of the non-discharge regions between blue discharge cells adjacent along the direction of the address electrodes.

In another embodiment, a plasma display panel includes a first substrate and a second substrate provided opposing one another with a predetermined gap therebetween. Address electrodes are formed on the second substrate. Barrier ribs are mounted between the first substrate and the second substrate, the barrier ribs defining a plurality of discharge cells; red, green, and blue phosphor layers formed within each of the discharge cells; and discharge sustain electrodes formed on the first substrate. Non-discharge cells are formed between discharge cells in a state in communication with each other to form a single non-discharge cell between adjacent rows of discharge cells, where "rows" of discharge cells refers to lines of adjacent discharge cells formed along the direction substantially perpendicular to the direction of the address electrodes. The discharge cells have lengths that are different according to the red, green, and blue colors of the phosphor layers formed therein such that the discharge cells have different volumes.

Each of the barrier ribs includes first barrier rib members formed substantially parallel to the direction of the address electrodes, and second barrier rib members obliquely connected to the first barrier rib members and intersecting over the address electrodes and forming the discharge cells in the shape of quadrilateral islands. The discharge cells satisfy the following condition, $$D_4(R)<D_4(G)<D_4(B)$$

where $D_4(R)$ is a length of red discharge cells along the direction of the address electrodes; $D_4(G)$ is a length of green discharge cells along the direction of the address electrodes; and $D_4(B)$ is a length of blue discharge cells along the direction of the address electrodes.

The discharge cells adjacent along the direction of the address electrodes are provided at different distances according to the red, green, and blue colors of the phosphor layers formed therein. The discharge cells satisfy the following condition, $$D_5(R)>D_5(G)>D_5(B)$$

where $D_5(R)$ is a distance between adjacent red discharge cells along the direction of the address electrodes; $D_5(G)$ is a distance between adjacent green discharge cells along the direction of the address electrodes; and $D_5(B)$ is a distance between adjacent blue discharge cells along the direction of the address electrodes.

In yet another embodiment, a plasma display panel includes a first substrate and a second substrate provided opposing one another with a predetermined gap therebetween. Address electrodes are formed on the second substrate. Barrier ribs are mounted between the first substrate and the second substrate, the barrier ribs defining a plurality of discharge cells and a plurality of non-discharge regions; red, green, and blue phosphor layers formed within each of the discharge cells. Discharge sustain electrodes are formed on the first substrate. The non-discharge regions are formed in areas encompassed by discharge cell abscissas that pass through centers of adjacent discharge cells and discharge cell ordinates that pass through centers of adjacent discharge cells, the non-discharge regions being at least as large as distal end widths of the barrier ribs forming the discharge cells. The discharge cells are formed having different volumes according to the color of the phosphor layers formed therein.

Each of the discharge cells is formed such that ends of the discharge cells gradually decrease in width along a direction the discharge sustain electrodes are formed as a distance from a center of the discharge cells is increased along a direction the address electrodes are formed.

The barrier ribs include first barrier rib members formed substantially parallel to the direction of the address electrodes, and second barrier rib members connected to the first barrier rib members and formed at an oblique angle to the direction of the address electrodes and in a direction intersecting over the address electrodes. The second barrier rib members are formed with a predetermined angle of spread between inner surfaces thereof within each end of the discharge cells. The second barrier rib members satisfy the following condition, $$\theta(R)<\theta(G)<\theta(B)$$

where $\theta(R)$ is the angle of spread between the second barrier rib members at each end of red discharge cells; $\theta(G)$ is the angle of spread between the second barrier rib members at each end of green discharge cells; and $\theta(B)$ is the angle of spread between the second barrier rib members at each end of blue discharge cells.

In still yet another embodiment, bridge barrier rib members of predetermined lengths are formed extending between each pair of discharge cells adjacent along the direction of the address electrodes. The bridge barrier rib members satisfy the following condition, $$D_6(R)>D_6(G)>D_6(B)$$

where $D_6(R)$ is a length of the bridge barrier rib members along the direction of the address electrodes and between red discharge cells adjacent in the same direction; $D_6(G)$ is a length of the bridge barrier rib members along the direction of the address electrodes and between green discharge cells adjacent in the same direction; and $D_6(B)$ is a length of the bridge barrier rib members along the direction of the address electrodes and between blue discharge cells adjacent in the same direction.

In still yet another embodiment, a distal end of at least one of each pair of opposing protrusion electrodes opposite proximal ends connected to and extended from the bus electrodes is formed including an indentation, and a first discharge gap and a second discharge gap of different sizes are formed between distal ends of opposing protrusion electrodes. The indentations are formed at a center of the protrusion electrodes along the direction substantially perpendicular the direction of the address electrodes.

The discharge cells are filled with discharge gas containing 10% or more Xenon. In one embodiment, the discharge cells are filled with discharge gas containing 10–60% Xenon.

The discharge sustain electrodes include scan electrodes and display electrodes provided such that one scan electrode and one common electrode correspond to each row of the discharge cells, the scan electrodes and the common electrodes including protrusion electrodes that extend into the discharge cells while opposing one another. The protrusion electrodes are formed such that a width of proximal ends thereof is smaller than a width of distal ends of the protrusion electrodes, and the address electrodes include line regions formed along a direction the address electrodes are formed, and enlarged regions formed at predetermined locations and expanding along a direction substantially perpendicular to the direction of the line regions to correspond to the shape of protrusion electrodes of the scan electrodes.

The enlarged regions of the address electrodes are formed to a first width at areas opposing the distal ends of the protrusion electrodes, and to a second width that is smaller than the first width at areas opposing the proximal ends of the protrusion electrodes.

In still yet another embodiment, the discharge sustain electrodes include scan electrodes and display electrodes provided such that one scan electrode and one display electrode correspond to each row of the discharge cells. Each of the scan electrodes and display electrodes includes bus electrodes extending along a direction substantially perpendicular to the direction the address electrodes are formed, and protrusion electrodes that extend into the discharge cells from the bus electrodes such that the protrusion electrodes of the scan electrodes oppose the protrusion electrodes of the display electrodes. One of the bus electrodes of the display electrodes is mounted between adjacent discharge cells of every other row of the discharge cells, and the bus electrodes of the scan electrodes are mounted between adjacent discharge cells and between the bus electrodes of the common electrodes.

The protrusion electrodes of the display electrodes are extended from the bus electrodes of the display electrodes into discharge cells adjacent to opposite sides of the bus electrodes, and the bus electrodes of the display electrodes have a width that is greater than a width of the bus electrodes of the scan electrodes.

DETAILED DESCRIPTION

Figure 1:
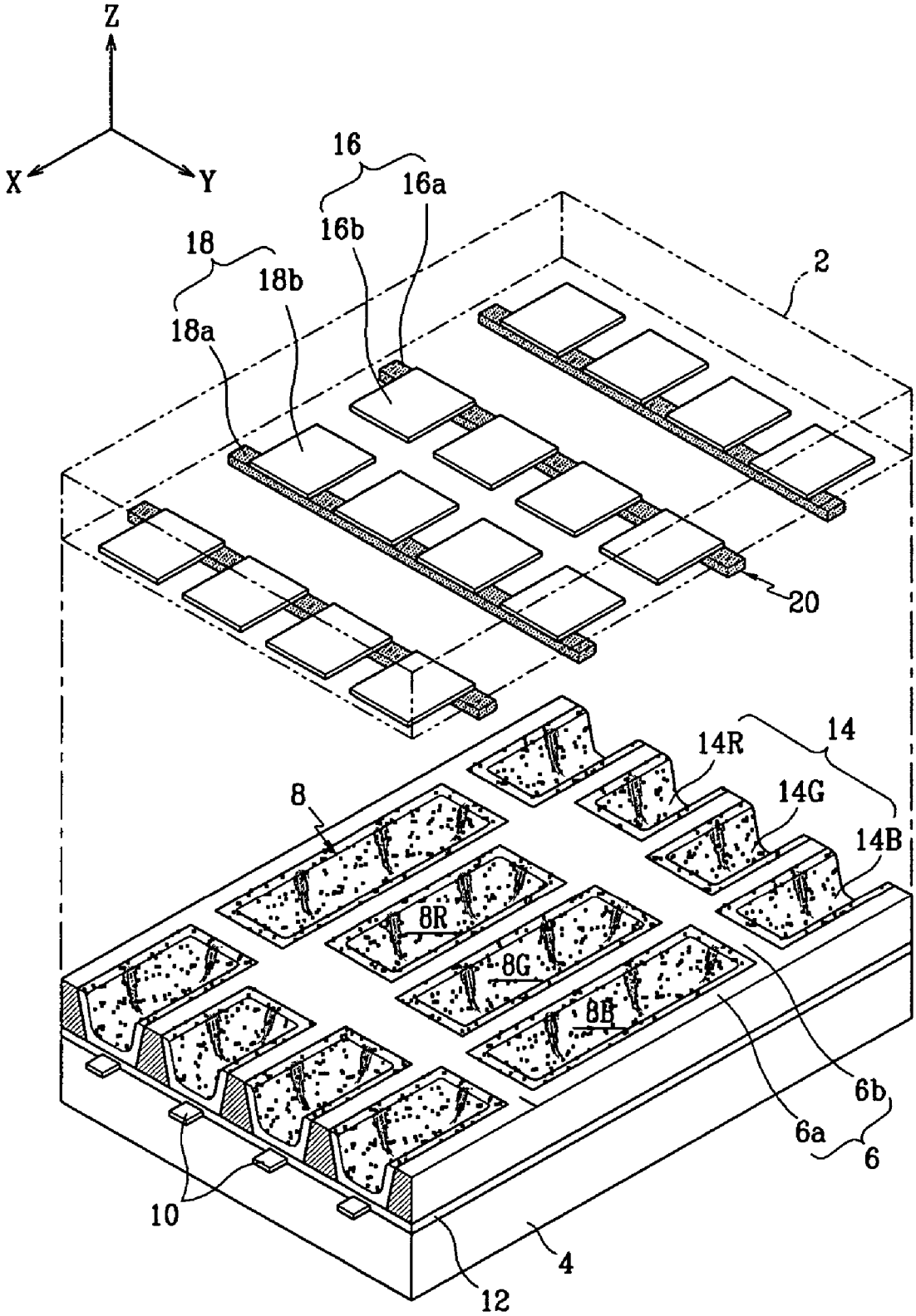
FIG. 1 is a partial exploded perspective view of a plasma display panel according to a first embodiment of the present invention.
Figure 2:
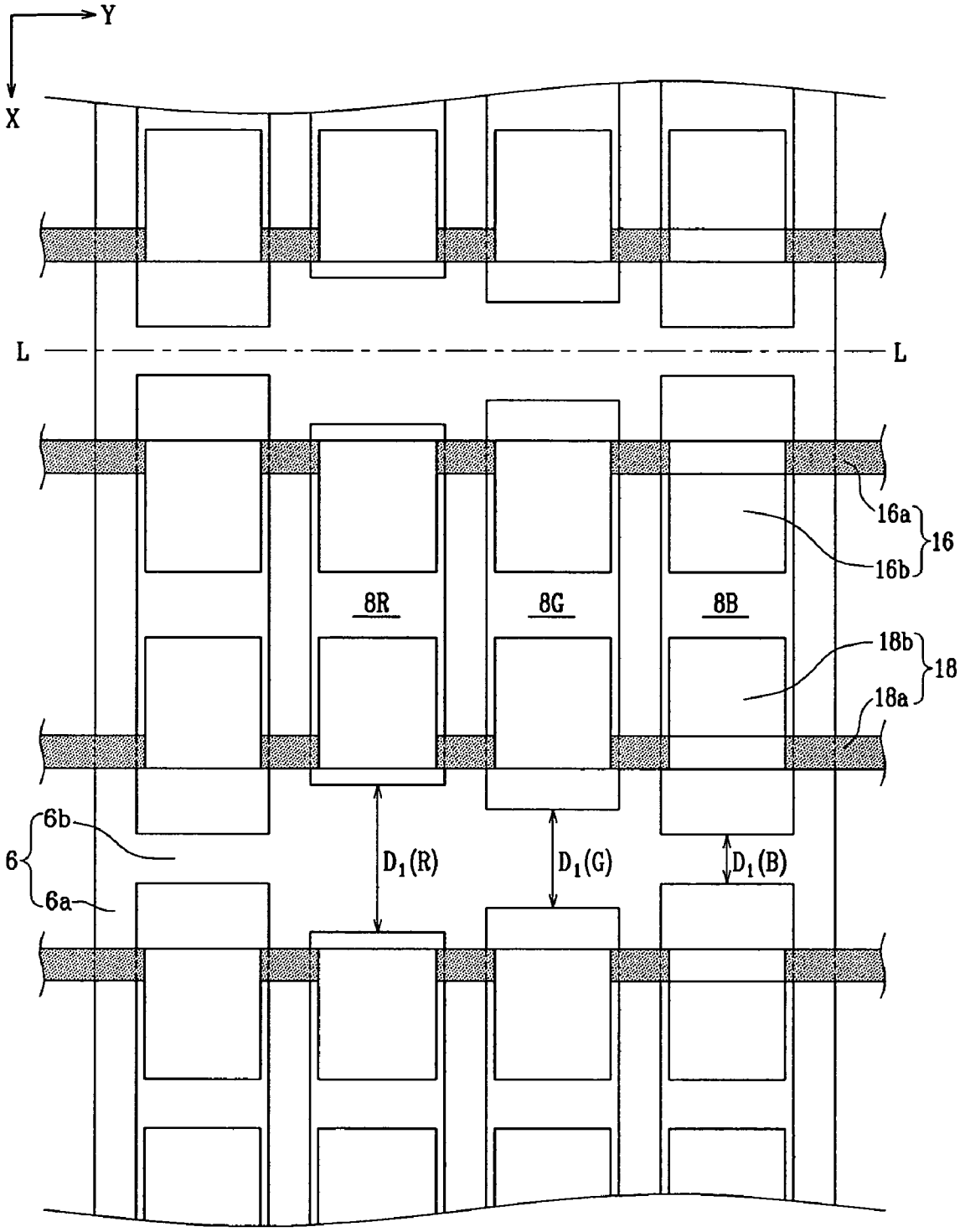
FIG. 2 is a partial plan view of the plasma display panel of FIG. 1.

FIG. 1 is a partial exploded perspective view of a plasma display panel according to a first embodiment of the present invention, and FIG. 2 is a partial plan view of the plasma display panel of FIG. 1.

A plasma display panel (PDP) according to the first embodiment includes first substrate 2 and second substrate 4 provided substantially in parallel with a predetermined gap therebetween. Barrier ribs 6 define discharge cells 8 between first substrate 2 and second substrate 4. Independent discharge taking place in each of the discharge cells 8 results in the emission of visible light for the display of color images.

In more detail, address electrodes 10 are formed along one direction (direction X in the drawings) on a surface of second substrate 4 opposing first substrate 2. Dielectric layer 12 is formed over an entire surface of second substrate 4 covering address electrodes 10. As an example, address electrodes 10 are formed in a uniform, stripe pattern with a predetermined interval therebetween.

Barrier ribs 6 are formed on dielectric layer 12. Barrier ribs 6 are formed in a matrix pattern. Red, green, and blue phosphor layers 14R, 14G, 14B are formed along all four side walls of barrier ribs 6 defining discharge cells 8, and on exposed areas of dielectric layer 12 within discharge cells 8. Barrier ribs 6 include first barrier rib members 6*a* formed substantially parallel to address electrodes 10, and second barrier rib members 6*b* formed along a direction substantially perpendicular to address electrodes 10 (along direction Y). Discharge gas (typically an Ne—Xe compound gas) is filled in discharge cells 8 defined by first barrier rib members 6*a* and second barrier rib members 6*b*.

Discharge sustain electrodes 20 comprised of scan electrodes 16 and display electrodes 18 are formed on a surface of first substrate 2 opposing second substrate 4. Discharge sustain electrodes 20 are formed along a direction substantially perpendicular the direction of address electrodes 10 (direction Y). A transparent dielectric layer (not shown) and an MgO protection layer (not shown) are formed over an entire surface of first substrate 2 covering discharge sustain electrodes 20.

In the first embodiment, discharge sustain electrodes 20 include bus electrodes 16*a*, 18*a* that are formed in a striped pattern and in pairs corresponding to discharge cells 8, and protrusion electrodes 16*b*, 18*b* that are formed extended into discharge cells 8 from bus electrodes 16*a*, 18*a*, respectively. Protrusion electrodes 16*b*, 18*b* are realized through transparent electrodes such as ITO (indium tin oxide) electrodes. In one embodiment, metal electrodes are used for bus electrodes 16*a*, 18*a*.

Using the above structure, an address voltage Va is applied between address electrodes 10 and scan electrodes 16 to select discharge cells 8 for illumination. Also, a discharge sustain voltage Vs is applied between display electrodes 18 and scan electrodes 16 of the selected discharge cells 8 such that discharge gas effects plasma discharge, and vacuum ultraviolet rays are emitted. The vacuum ultraviolet rays excite phosphor layers 14 of the selected discharge cells 8R, 8G, 8B so that phosphor layers 14 glow (i.e., emit visible light) to thereby enable color display.

In the first embodiment, the structure of barrier ribs 6 that define discharge cells 8 is varied according to the characteristics of red, green, and blue phosphors such that when red, green, and blue discharge cells 8R, 8G, 8B are grouped together to form a single pixel, phosphor efficiency and discharge characteristics of each discharge cell 8 is made uniform. Except barrier ribs 6, changes in the structure of other elements are minimized, and volumes of discharge cells 8 are made different according to color.

In more detail, with reference to FIG. 2, first barrier rib members 6*a* of barrier ribs 6 are formed to substantially the same thickness along the direction parallel to address electrodes 10, and separate red, green, and blue discharge cells 8R, 8G, 8B along this same direction (direction Y). Second barrier rib members 6*b* are positioned between discharge cells 8 adjacent along the direction of address electrodes 10 to separate these discharge cells 8, and have different widths along the same direction according to the color of discharge cells 8.

That is, second barrier rib members 6*b* satisfy the following condition of Formula 1.

$$D_1(R)>D_1(G)>D_1(B) \quad \text{[Formula 1]}$$

where $D_1(R)$ is a width of second barrier rib members 6*b* along direction X between red discharge cells 8R, $D_1(G)$ is a width of second barrier rib members 6*b* along direction X between green discharge cells 8G, and $D_1(B)$ is a width of second barrier rib members 6*b* along direction X between blue discharge cells 8B.

Second barrier rib members 6*b* adjacent along the direction substantially perpendicular to the direction of address electrodes 10 have a common horizontal reference line (L). The common horizontal reference line (L) passes through centers of the widths of second barrier rib members 6*b*.

By varying the widths of only second barrier rib members 6*b*, a volume of blue discharge cells 8B with the lowest brightness ratio is made the largest, while a volume of red discharge cells 8R with the highest brightness ratio is made the smallest. As a result, the phosphor efficiency and discharge characteristics of each of the discharge cells 8R, 8G, 8B are made uniform to thereby enhance color temperature characteristics, and ensure uniform discharge.

Additional embodiments of the present invention will now be described with reference to FIGS. 3–6.

Figure 3:
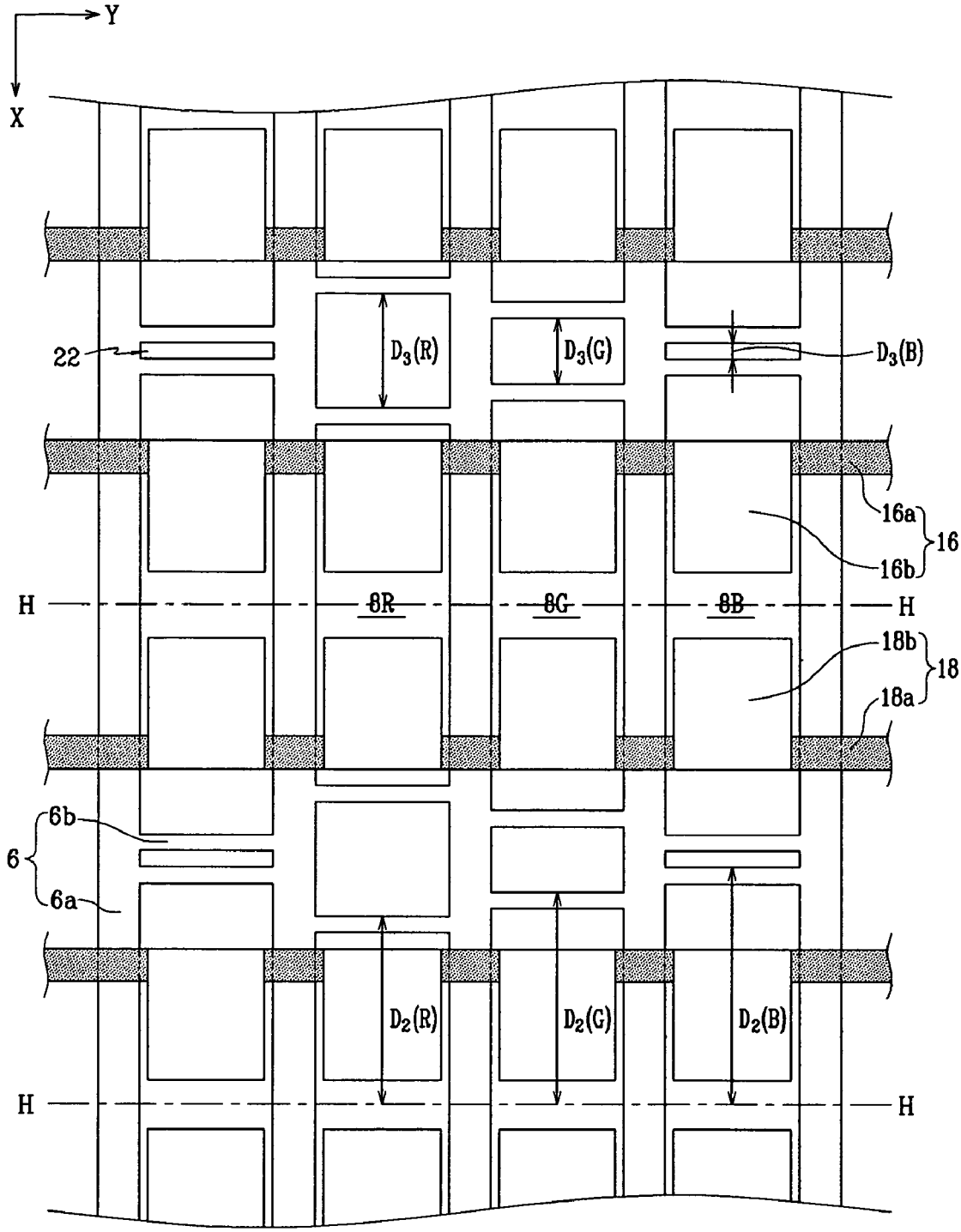
FIG. 3 is a partial plan view of a plasma display panel according to a second embodiment of the present invention.

FIG. 3 is a partial plan view of a plasma display panel according to a second embodiment of the present invention. Using the basic configuration of the first embodiment, non-discharge cells 22 are formed within second barrier rib members 6*b*. Non-discharge cells 22 are spaces fully encompassed by second barrier rib members 6*b*, and are regions where gas discharge and illumination are not expected to take place. Non-discharge cells 22 absorb heat emitted from discharge cells 8R, 8G, 8B, and expel this heat to outside the PDP to thereby enhance heat-emitting characteristics of the same.

Non-discharge cells 22 are formed between discharge cells 8 of the same color and adjacent along the direction of address electrodes 10 (see FIG. 1). That is, if horizontal lines H are drawn along the direction substantially perpendicular to address electrodes 10 (along direction Y) intersecting centers of discharge cells 8R, 8G, 8B along the direction of address electrodes 10 (along direction X), non-discharge cells 22 satisfy the following condition.

$$D_2(R)<D_2(G)<D_2(B) \quad \text{[Formula 2]}$$

where $D_2(R)$ is a distance between horizontal lines H and closest edges of non-discharge cells 22 of adjacent pairs of red discharge cells 8R closest to horizontal lines H, $D_2(G)$ is a distance between horizontal lines H and closest edges of non-discharge cells 22 of adjacent pairs of green discharge cells 8G closest to horizontal lines H, and $D_2(B)$ is a distance between horizontal lines H and closest edges of non-discharge cells 22 of adjacent pairs of blue discharge cells 8B closest to horizontal lines H.

Another way of describing the same configuration is by describing different volumes of non-discharge cells 22 according to the color of discharge cells 8. In particular, non-discharge cells 22 satisfy the condition of Formula 3 below. It is assumed that intervals between first barrier rib members 6*a* along the direction substantially perpendicular the direction of address electrodes 10 (direction Y) are the same.

$$D_3(R)>D_3(G)>D_3(B) \quad \text{[Formula 3]}$$

where $D_3(R)$ is a width of non-discharge regions 22 between red discharge cells 8R adjacent along the direction of address electrodes 10, $D_3(G)$ is a width of non-discharge regions 22 between green discharge cells 8G adjacent along the direction of address electrodes 10, and $D_3(B)$ is a width of non-discharge regions 22 between blue discharge cells 8B adjacent along the direction of address electrodes 10.

Figure 4:
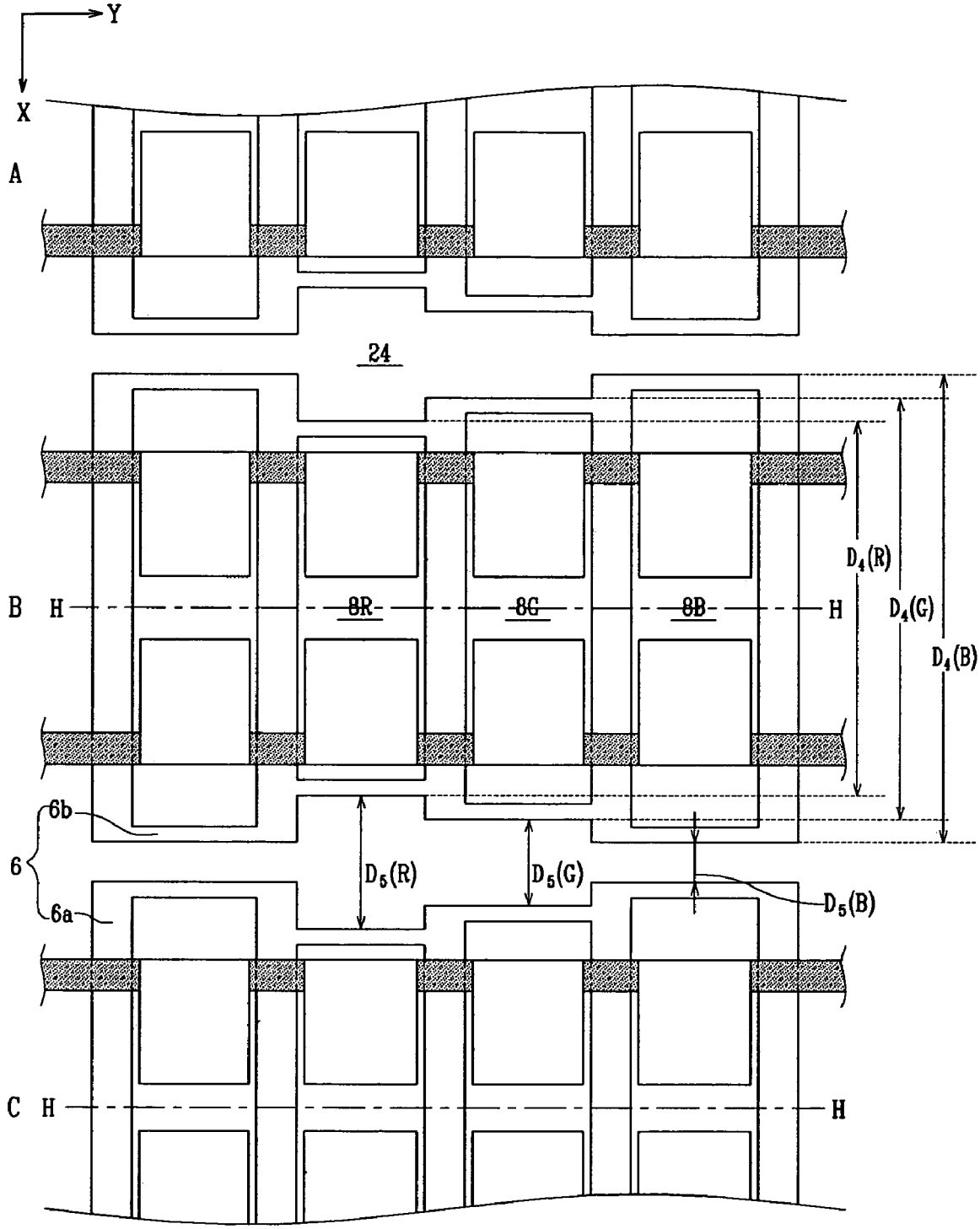
FIG. 4 is a partial plan view of a plasma display panel according to a third embodiment of the present invention.

FIG. 4 is a partial plan view of a plasma display panel according to a third embodiment of the present invention. Using the basic configuration of the second embodiment, non-discharge cells formed between discharge cells 8R, 8G, 8B are in communication to form a single non-discharge cell 24 between adjacent rows of discharge cells 8R, 8G, 8B, where "rows" of discharge cells 8R, 8G, 8B refers to lines of adjacent discharge cells 8R, 8G, 8B formed along the direction substantially perpendicular to the direction of address electrodes 10 (see FIG. 1). As a result, discharge cells 8 are adjacent to each at predetermined intervals along direction Y, and at varying intervals with non-discharge cells 24 interposed therebetween along direction X.

In the third embodiment, each of the discharge cells 8R, 8G, 8B is formed as rectangular islands surrounded by first barrier rib members 6*a* and second barrier rib members 6*b*. Further, distances between first barrier rib members 6*a* adjacent in direction Y are substantially identical, that is, widths of discharge cells 8 along direction Y are substantially identical. However, distances between second barrier rib members 6*b* adjacent in direction X vary in such a manner that red, green, and blue discharge cells 8R, 8G, 8B have different volumes. In particular, discharge cells 8 satisfy the following condition.

$$D_4(R)<D_4(G)<D_4(B) \quad \text{[Formula 4]}$$

where $D_4(R)$ is a length of red discharge cells 8R along the direction of address electrodes 10, $D_4(G)$ is a length of green discharge cells 8G along the direction of address electrodes 10, and $D_4(B)$ is a length of blue discharge cells 8B along the direction of address electrodes 10.

If horizontal lines H are drawn along the direction substantially perpendicular to address electrodes 10 (along direction Y) intersecting centers of discharge cells 8R, 8G, 8B along the direction of address electrodes 10 (along direction X), distances between horizontal lines H and closest edges of non-discharge cells 24 between adjacent pairs of discharge cells 8 along direction X are the same for like colors of discharge cells 8 and vary between the different colors of discharge cells 8. Stated differently, discharge cells 8 satisfy the condition of Formula 5 below.

$$D_5(R)>D_5(G)>D_5(B) \quad \text{[Formula 5]}$$

where $D_5(R)$ is a distance between adjacent red discharge cells 8R along the direction of address electrodes 10, $D_5(G)$ is a distance between adjacent green discharge cells 8G along the direction of address electrodes 10, and $D_5(B)$ is a distance between adjacent blue discharge cells 8B along the direction of address electrodes 10.

With the formation of a single non-discharge cell 24 common to adjacent rows of discharge cells 8 as described above, the overall volume of non-discharge cells 24 may be increased such that heat-emitting effects are further increased over the second embodiment.

Figure 5:
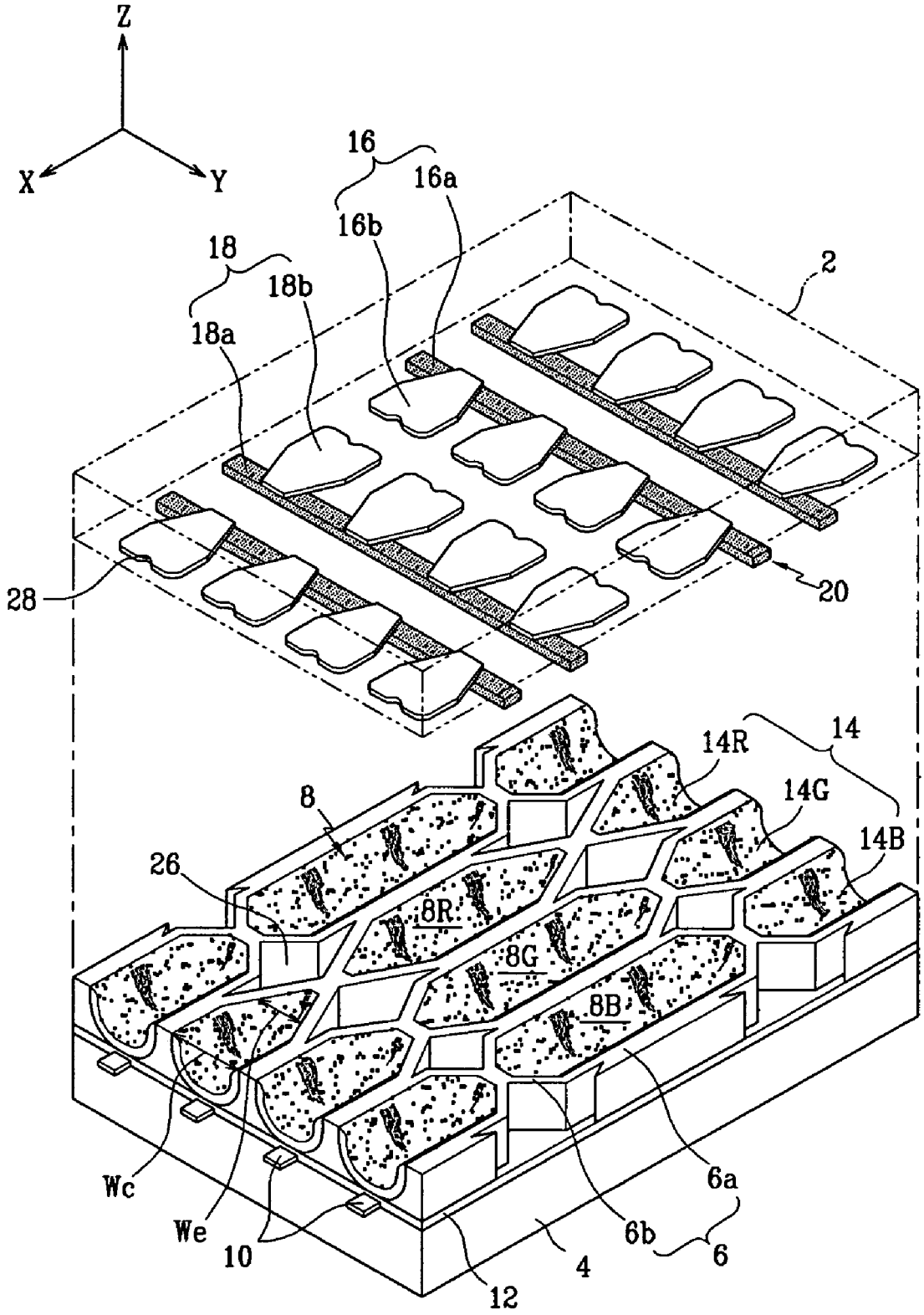
FIG. 5 is a partial exploded perspective view of a plasma display panel according to a fourth embodiment of the present invention.
Figure 6:
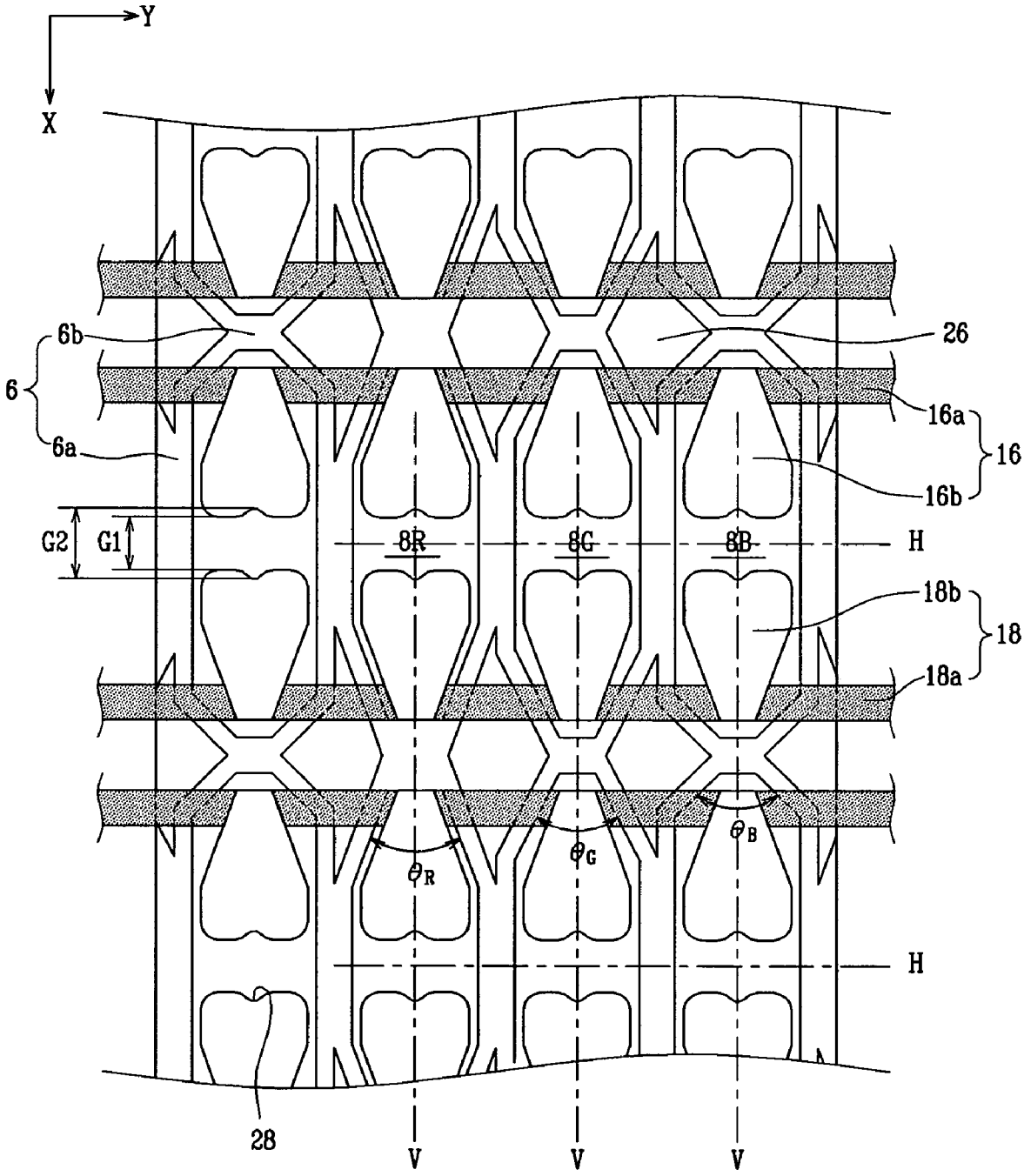
FIG. 6 is a partial plan view of the plasma display panel of FIG. 5.

FIG. 5 is a partial exploded perspective view of a plasma display panel according to a fourth embodiment of the present invention, and FIG. 6 is a partial plan view of the plasma display panel of FIG. 5. In this embodiment, discharge cells 8R, 8G, 8B have different volumes according to red, green, and blue phosphor characteristics, and are optimally formed to enhance the diffusion of plasma discharge. Non-discharge regions 26 are also provided.

A plurality of non-discharge regions 26 and a plurality of discharge cells 8R, 8G, 8B are defined by barrier ribs 6. Barrier ribs 6 define discharge cells 8R, 8G, 8B along a direction of address electrodes (direction X), and along a direction substantially perpendicular the direction of address electrodes (direction Y). Non-discharge regions 26 are formed in areas encompassed by discharge cell abscissas (H) and ordinates (V) that pass through centers of each of the discharge cells 8R, 8G, 8B, and that are aligned respectively with directions X and Y.

Ends of discharge cells 8R, 8G, 8B are formed reducing in width along direction Y as a distance from a center of each of the discharge cells 8R, 8G, 8B is increased in the direction that address electrodes 10 are provided (direction X). Such a configuration is continued until reaching a point of minimal width such that the ends of discharge cells 8R, 8G, 8B are wedge-shaped. Therefore, discharge cells 8R, 8G, 8B have an overall planar shape of a hexagon.

That is, as shown in FIG. 5, a width Wc of a mid-portion of discharge cells 8R, 8G, 8B is greater than a width We of the ends of discharge cells 8R, 8G, 8B, with width We of the ends decreasing up to a certain point as the distance from the center of discharge cells 8R, 8G, 8B is increased. Therefore, in the fourth embodiment, the ends of discharge cells 8R, 8G, 8B are formed in the shape of a trapezoid (with its base removed) until reaching a predetermined location where barrier ribs 6 close off discharge cells 8R, 8G, 8B. This results in each of the discharge cells 8R, 8G, 8B having an overall planar shape of an octagon.

Non-discharge regions 26 defined by barrier ribs 6 are formed in areas encompassed by discharge cell abscissas H and ordinates V that pass through centers of each of the discharge cells 8R, 8G, 8B, and that are respectively aligned with direction Y and direction X as described above. In one embodiment, non-discharge regions 26 are centered between adjacent abscissas H and adjacent ordinates V. Stated differently, in one embodiment each pair of discharge cells 8R, 8G, 8B adjacent to one another along direction X has a common non-discharge region 26 with another such pair of discharge cells 8R, 8G, 8B adjacent along direction Y. With this configuration realized by barrier ribs 6, each of the non-discharge regions 26 has an independent cell structure.

Barrier ribs 6 defining non-discharge regions 26 and discharge cells 8R, 8G, 8B in the manner described above include first barrier rib members 6*a* that are parallel to address electrodes 10, and second barrier rib members 6*b* that define the ends of discharge cells 8R, 8G, 8B as described above and so are not parallel to, that is, oblique to, address electrodes 10. Second barrier rib members 6*b* are formed extending up to a point, then extending in the direction Y to cross over address electrodes 10. Therefore, second barrier rib members 6*b* are formed in substantially an X shape between discharge cells 8R, 8G, 8B adjacent along the direction of address electrodes 10. Second barrier rib members 6*b* can further separate diagonally adjacent discharge cells with a non-discharge region therebetween.

In the fourth embodiment, an angle of spread 0 between inner surfaces of second barrier rib members 6*b* of each end of discharge cells 8 is varied according to the color of red, green, and blue discharge cells 8R, 8G, 8B, thereby resulting in different volumes of discharge cells 8 according to color. In particular, discharge cells 8 satisfy the condition of Formula 6 below.

$$\theta(R)<\theta(G)<\theta(B) \quad \text{[Formula 6]}$$

where θ(R) is the angle of spread between second barrier rib members 6*b* at each end of red discharge cells 8R, θ(G) is the angle of spread between second barrier rib members 6*b* at each end of green discharge cells 8G, and θ(B) is the angle of spread between second barrier rib members 6*b* at each end of blue discharge cells 8B.

As a result of the configuration described above, non-discharge regions 26 are formed differently depending on the angle of spread of second barrier rib members 6*b* defining non-discharge regions 26.

With discharge cells 8 provided in an optimum configuration with respect to the manner in which plasma discharge is diffused (i.e., starting in spaces between two opposing protruding electrodes and spreading in all directions from this area), phosphor layers 14 produce vacuum ultraviolet rays of a greater intensity over a greater area during generation of vacuum ultraviolet rays by plasma discharge. Accordingly, the efficiency of phosphors in converting effective ultraviolet rays into visible light is improved in the third embodiment, thereby resulting in enhanced discharge efficiency and screen brightness.

Discharge sustain electrodes 20 are formed on an inner surface of first substrate 2. Discharge sustain electrodes 20, and in particular, protrusion electrodes 16*b*, 18*b* of discharge sustain electrodes 20 are formed to an optimum configuration to match the shape of discharge cells 8. That is, protrusion electrodes 16*b*, 18*b* are formed substantially corresponding to ends of discharge cells 8 such that proximal ends (i.e., in the area where protrusion electrodes 16*b*, 18*b* are connected to bus electrodes 16*a*, 18*a*, respectively) decrease in width as bus electrodes 16*a*, 18*b* are approached.

Further, distal ends of protrusion electrodes 16*b*, 18*b* are formed such that center areas along direction Y are indented and sections to both sides of the indentations are protruded. Therefore, in each of the discharge cells 8R, 8G, 8B, first discharge gap G1 and second discharge gap G2 of different sizes are formed between opposing protrusion electrodes 16*b*, 18*b*. That is, second discharge gaps G2 (or long gaps) are formed where the indentations of protrusion electrodes 16*b*, 18*b* oppose one another, and first discharge gaps G1 (or short gaps) are formed where the protruded areas to both sides of the indentations of protrusion electrodes 16*b*, 18*b* oppose one another. Accordingly, with the application of a sustain voltage Vs between scan electrodes 16 and display electrodes 18, plasma discharge begins in centers of first gaps G1, then spreads outwardly. Plasma discharge also starts in a center of second gap G2 and spreads outwardly from this area. That is, plasma discharge begins substantially simultaneously in centers of first gaps G1 and second gap G2.

Accordingly, since plasma discharge spreads to peripheries of discharge cells 8 starting substantially simultaneously from centers and exterior areas of discharge cells 8, brightness within discharge cells 8 is uniform, and discharge efficiency and instantaneous brightness are enhanced.

In addition, protrusion electrodes 16*b*, 18*b* are formed with first and second gaps G1, G2 interposed therebetween to thereby reduce a discharge firing voltage Vf. Accordingly, the amount of Xenon contained in the discharge gas may be increased without having to increase the discharge firing voltage Vf. Therefore, the discharge gas filled in discharge cells 8 contains 10% or more Xe. In one embodiment, the discharge gas contains 10–60% Xenon. With the increased Xenon content, vacuum ultraviolet rays may be emitted with a greater intensity to thereby enhance screen brightness.

Figure 7:
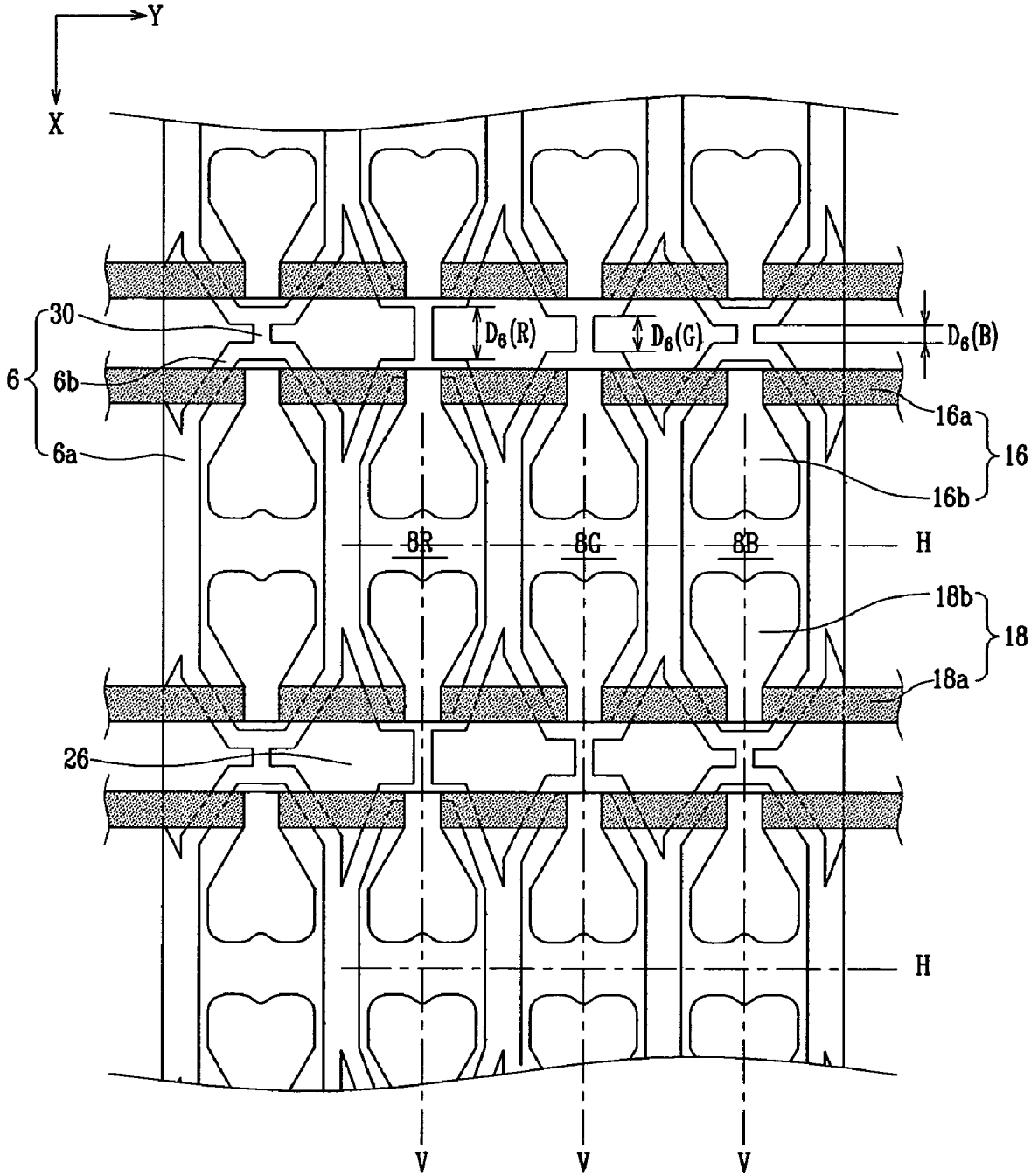
FIG. 7 is a partial plan view of a plasma display panel according to a fifth embodiment of the present invention.

FIG. 7 is a partial plan view of a plasma display panel according to a fifth embodiment of the present invention. The basic configuration of the fourth embodiment is used. However, rather than varying the angle of spread between second barrier rib members 6*b*, a bridge barrier rib member 30 is formed extending between each pair of discharge cells 8R, 8G, 8B adjacent along the direction of address electrodes 10 (see FIG. 1). Bridge barrier rib members 30 are formed to different lengths depending on whether they are between pairs of red discharge cells 8R, green discharge cells 8G, or blue discharge cells 8B. This configuration results in different volumes for discharge cells 8R, 8G, 8B depending on color.

In particular, the following condition of Formula 7 is satisfied.

$$D_6(R)>D_6(G)>D_6(B) \quad \text{[Formula 7]}$$

where $D_6(R)$ is a length of bridge barrier rib members 30 (or a distance between adjacent second barrier rib members 6*b*) along the direction of address electrodes 10 and between red discharge cells 8R adjacent in the same direction, $D_6(G)$ is a length of bridge barrier rib members 30 (or a distance between adjacent second barrier rib members 6*b*) along the direction of address electrodes 10 and between green discharge cells 8G adjacent in the same direction, and $D_6(B)$ is a length of bridge barrier rib members 30 (or a distance between adjacent second barrier rib members 6*b*) along the direction of address electrodes 10 and between blue discharge cells 8B adjacent in the same direction.

Figure 8:
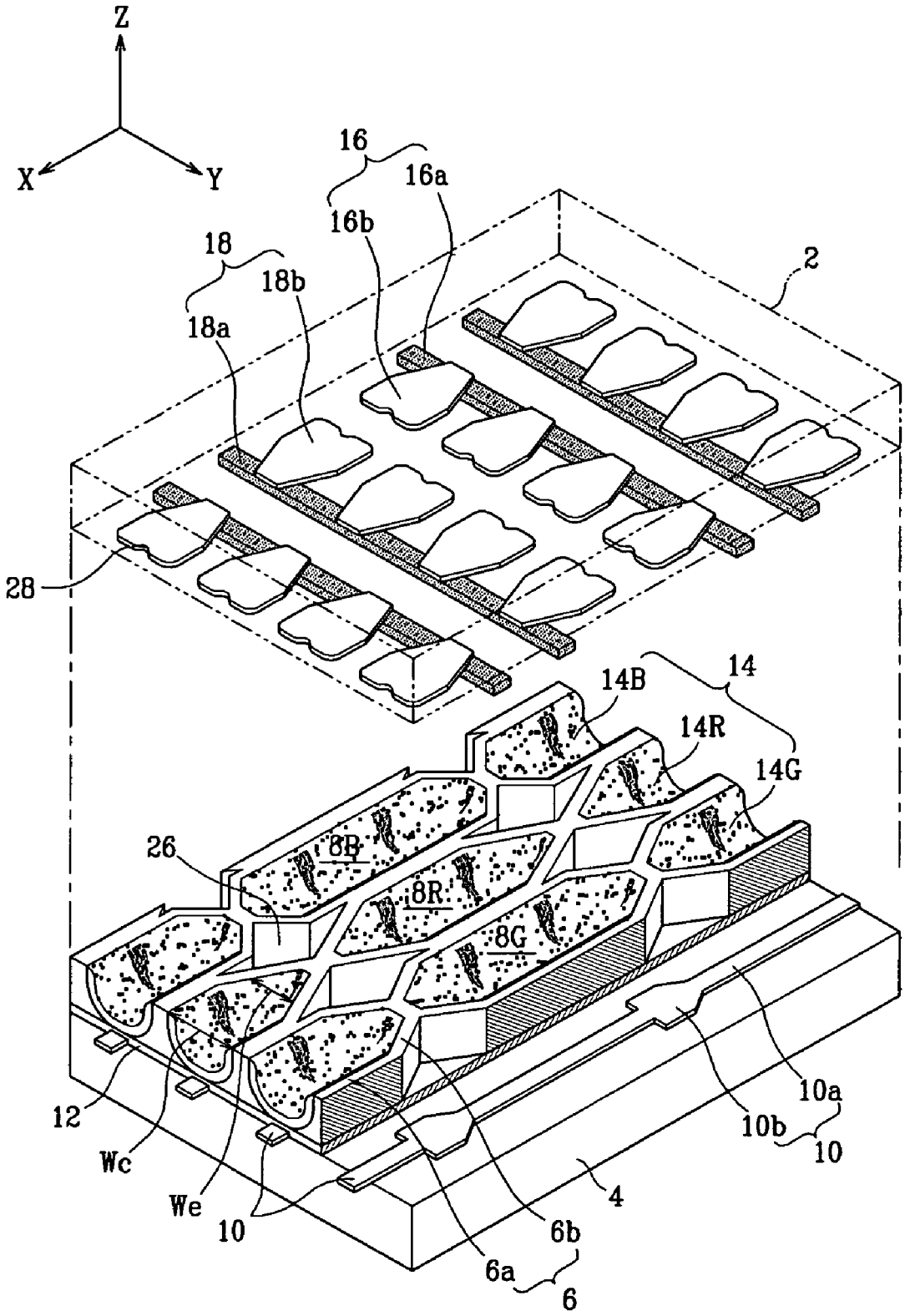
FIG. 8 is a partial exploded perspective view of a plasma display panel according to a sixth embodiment of the present invention.
Figure 9:
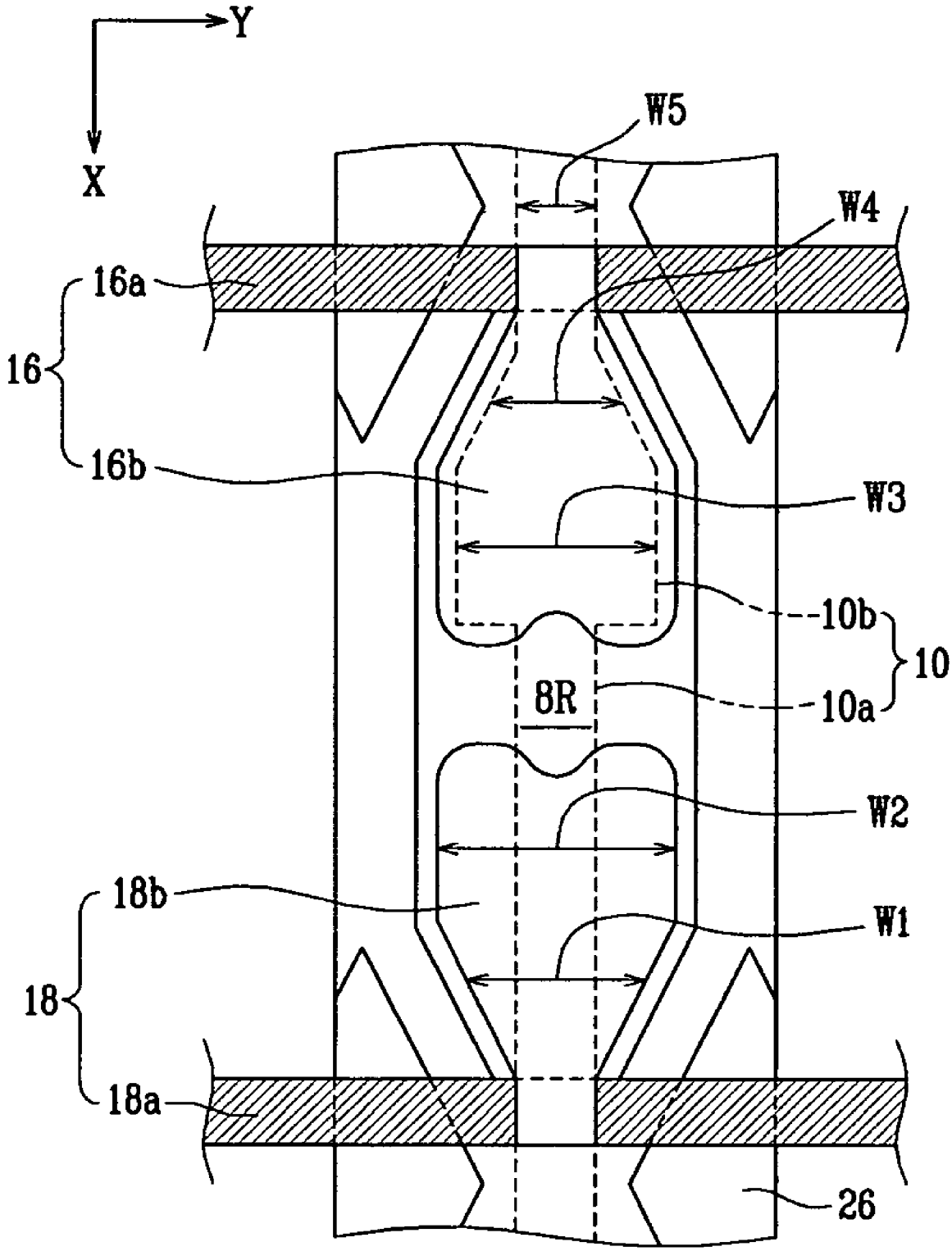
FIG. 9 is an enlarged plan view of a select portion of the plasma display panel of FIG. 8.

FIG. 8 is a partial exploded perspective view of a plasma display panel according to a sixth embodiment of the present invention, and FIG. 9 is an enlarged plan view of a select portion of the plasma display panel of FIG. 8.

In the PDP according to the sixth embodiment, barrier ribs 6 define non-discharge regions 26 and discharge cells 8R, 8G, 8B as in the fourth embodiment. Further, discharge sustain electrodes 16, 18 are formed along a direction (direction Y) substantially perpendicular to the direction address electrodes 10 are formed. Discharge sustain electrodes 16 are scan electrodes, and discharge sustain electrodes 18 are display electrodes. Scan electrodes 16 and display electrodes 18 include bus electrodes 16*a*, 18*a*, respectively, that extend along the direction substantially perpendicular the direction address electrodes 10 are formed (direction Y). Scan electrodes 16 and display electrodes 18 also include protrusion electrodes 16*b*, 18*b*, respectively, that are extended respectively from bus electrodes 16*a*, 18*a*.

For each row of discharge cells 8R, 8G, 8B along direction Y, bus electrodes 16*a* are extended along one end of discharge cells 8R, 8G, 8B, and bus electrodes 18*a* are extended into an opposite end of discharge cells 8R, 8G, 8B. Therefore, each of the discharge cells 8R, 8G, 8B has one of the bus electrodes 16*a* positioned over one end, and one of the bus electrodes 18*a* positioned over its other end. Protrusion electrodes 16*b* overlap and protrude from corresponding bus electrode 16*a* into the areas of discharge cells 8R, 8G, 8B. Also, protrusion electrodes 18*b* overlap and protrude from the corresponding bus electrode 18*b* into the areas of discharge cells 8R, 8G, 8B. Therefore, one protrusion electrode 16*b* and one protrusion electrode 18*b* are formed opposing one another in each area corresponding to each of the discharge cells 8R, 8G, 8B.

Proximal ends of protrusion electrodes 16*b*, 18*b* (i.e., where protrusion electrodes 16*b*, 18*b* are attached to and extend from bus electrodes 16*a*, 18*a*, respectively) are formed corresponding to the shape of the ends of discharge cells 8R, 8G, 8B. That is, the proximal ends of protrusion electrodes 16*b*, 18*b* reduce in width along direction Y as the distance from the center of discharge cells 8R, 8G, 8B along direction X is increased to thereby correspond to the shape of the ends of discharge cells 8R, 8G, 8B.

In the sixth embodiment, address electrodes 10 include enlarged regions 10*b* formed corresponding to the shape and location of protrusion electrodes 16*b* of scan electrodes 16. Enlarged regions 10*b* increase an area of scan electrodes 16 that oppose address electrodes 10. In more detail, address electrodes 10 include line regions 10*a* formed along direction X, and enlarged regions 10*b* formed at predetermined locations and expanding along direction Y corresponding to the shape of protrusion electrodes 16*b* as described above.

As shown in FIG. 9, when viewed from a front of the PDP, areas of enlarged regions 10*b* of address electrodes 10 opposing distal ends of protrusions 16*b* of scan electrodes 16 are substantially rectangular having width W3, and areas of enlarged regions 10*b* of address electrodes 10 opposing proximal ends of protrusions 16*b* of scan electrodes 16 are substantially wedge-shaped having width W4 that is less than width W3 and decreases gradually as bus electrodes 16*a* are neared. With width W5 corresponding to the width of line regions 10*a* of address electrodes 10, the following inequalities are maintained: W3>W5 and W4>W5.

With the formation of enlarged regions 10*b* at areas opposing scan electrodes 16 of address electrodes 10 as described above, address discharge is activated when an address voltage is applied between address electrodes 10 and scan electrodes 16, and the influence of display electrodes 18 is not received. Accordingly, in the PDP of the tenth embodiment, address discharge is stabilized such that mis-discharge during address discharge and sustain discharge, and an address voltage margin is increased.

Such a configuration of address electrodes 10 may be applied to the other embodiments.

Figure 10:
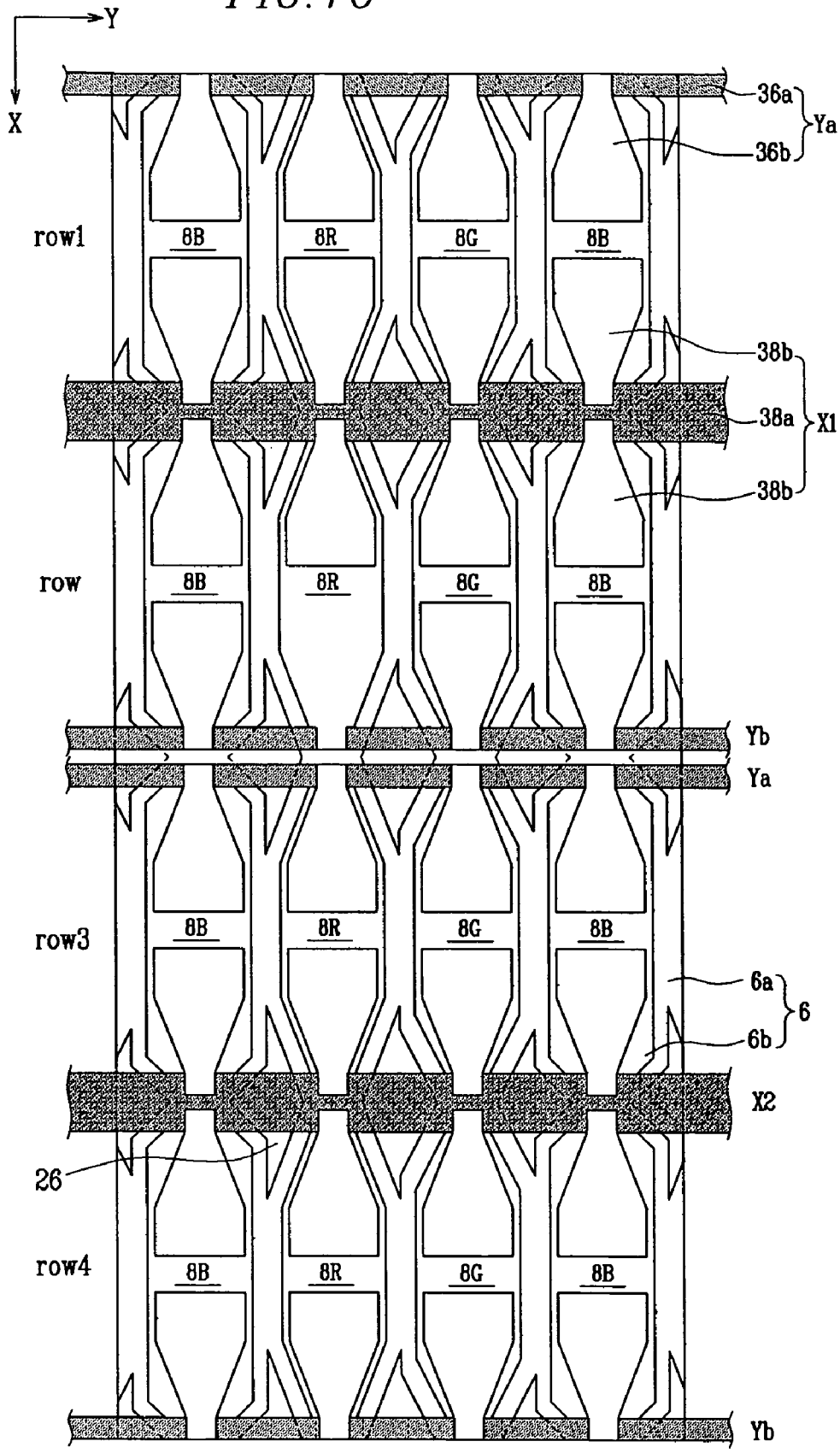
FIG. 10 is a partial plan view of a plasma display panel according to a seventh embodiment of the present invention.

FIG. 10 is a partial plan view of a plasma display panel according to a seventh embodiment of the present invention.

In the PDP according to the seventh embodiment, barrier ribs 6 define non-discharge regions 26 and discharge cells 8R, 8G, 8B as in the fourth embodiment. Further, discharge sustain electrodes are formed along a direction (direction Y) substantially perpendicular to the direction address electrodes 10 are formed. The discharge sustain electrodes include scan electrodes (Ya, Yb) and display electrodes Xn (where n=1,2,3, . . . ).

Scan electrodes (Ya, Yb) and display electrodes Xn include bus electrodes 36*a*, 38*a*, respectively, that extend along the direction address electrodes 10 are formed (direction Y), and protrusion electrodes 36*b*, 38*b*, respectively, that are extended respectively from bus electrodes 36*a*, 38*a* such that a pair of protrusion electrodes 36*b*, 38*b* oppose one another in each discharge cell 8R, 8G, 8B. Scan electrodes (Ya, Yb) act together with address electrodes 10 to select discharge cells 8R, 8G, 8B, and display electrodes Xn act to initialize discharge and generate sustain discharge.

Letting the term "rows" be used to describe lines of discharge cells 8R, 8G, 8B adjacent along direction Y, bus electrodes 38*a* of display electrodes Xn are provided such that one of the bus electrodes 38*a* is formed overlapping ends of discharge cells 8R, 8G, 8B in every other pair of rows adjacent along direction X. Further, bus electrodes 36*a* of scan electrodes (Ya, Yb) are provided such that one bus electrode 36*a* of scan electrodes Ya and one bus electrode 36*a* of scan electrodes Yb are formed overlapping ends of discharge cells 8R, 8G, 8B in every other pair of rows adjacent along direction X. Along this direction X, scan electrodes (Ya, Yb) and display electrodes Xn are provided in an overall pattern of Ya-X1-Yb-Ya-X2-Yb-Ya-X3-Yb- . . . -Ya-Xn-Yb. With this configuration, display electrodes Xn are able to participate in the discharge operation of all discharge cells 8R, 8G, 8B.

Further, bus electrodes 38*a* of common electrodes Xn are formed covering a greater area along direction X than pairs of bus electrodes 36*a* of scan electrodes (Ya, Yb). This is because bus electrodes 38*a* of display electrodes Xn absorb outside light to thereby improve contrast.

In the PDP of the present invention described above, changes in the structure of all elements except the barrier are minimized, and volumes of the discharge cells are made different according to color. Accordingly, when red, green, and blue discharge cells are grouped together to form pixels, phosphor efficiency and discharge characteristics of each discharge cell is made uniform, color temperature characteristics are improved, and uniform discharge is ensured.

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A plasma display panel, comprising:

a first substrate and a second substrate provided opposing one another with a predetermined gap therebetween;

address electrodes formed on the second substrate;

barrier ribs mounted between the first substrate and the second substrate, the barrier ribs defining a plurality of discharge cells;

red phosphor layers, green phosphor layers, and blue phosphor layers formed within each of respective red discharge cells, green discharge cells and blue discharge cells; and discharge sustain electrodes formed on the first substrate, wherein non-discharge cells are formed between discharge cells in communication with each other to form a single non-discharge cell between adjacent rows of discharge cells, rows of discharge cells being adjacent discharge cells formed along the direction substantially perpendicular to the direction of the address electrodes, and wherein the discharge cells have lengths that are different according to the respective red color, green color, and blue color of the phosphor layers formed therein such that the discharge cells have different volumes.

2. The plasma display panel of claim 1, wherein each of the barrier ribs comprises first barrier rib members formed substantially parallel to the direction of the address electrodes, and second barrier rib members connected obliquely to the first barrier rib members, and which form the discharge cells in the shape of quadrilateral islands.

3. The plasma display panel of claim 1, wherein the discharge cells satisfy the following condition, $$D_4(R)<D_4(G)<D_4(B)$$

where $D_4(R)$ is a length of red discharge cells along the direction of the address electrodes; $D_4(G)$ is a length of green discharge cells along the direction of the address electrodes; and $D_4(B)$ is a length of blue discharge cells along the direction of the address electrodes.

4. The plasma display panel of claim 1, wherein the discharge cells have common horizontal lines drawn along the direction substantially perpendicular to the address electrodes intersecting centers of the discharge cells along the direction of address electrodes.

5. The plasma display panel of claim 1, wherein the discharge sustain electrodes include bus electrodes that extend such that a pair of the bus electrodes is provided for each of the discharge cells, and protrusion electrodes formed extending from each of the bus electrodes such that a pair of opposing protrusion electrodes is formed within areas corresponding to each discharge cell.

6. The plasma display panel of claim 1, wherein the discharge cells adjacent along the direction of the address electrodes are provided at different distances according to the red color, green color, and blue color of the respective phosphor layers formed therein.

7. The plasma display panel of claim 6, wherein the discharge cells satisfy the following condition, $$D_5(R)>D_5(G)>D_5(B)$$

where $D_5(R)$ is a distance between adjacent red discharge cells along the direction of the address electrodes; $D_5(G)$ is a distance between adjacent green discharge cells along the direction of the address electrodes; and $D_5(B)$ is a distance between adjacent blue discharge cells along the direction of the address electrodes.

* * * * *

UNITED STATES PATENT AND TRADEMARK OFFICE

CERTIFICATE OF CORRECTION

PATENT NO. : 7,208,876 B2
APPLICATION NO. : 10/874517
DATED : April 24, 2007
INVENTOR(S) : Kang et al.

It is certified that error appears in the above-identified patent and that said Letters Patent is hereby corrected as shown below:

On the Title Page

| | |
|---|---|
| Item (56) References Cited<br>Other Publications, pg. 2, Col. 2<br>Patent Abstracts of Japan for<br>Publications No. 2002-083545. . . | Delete "T. Kunii",<br>Insert --Y. Kunii-- |

Signed and Sealed this

Sixteenth Day of October, 2007

JON W. DUDAS
*Director of the United States Patent and Trademark Office*